US010006155B2

(12) United States Patent
Oe

(10) Patent No.: US 10,006,155 B2
(45) Date of Patent: Jun. 26, 2018

(54) MARKER FOR KNITTING

(71) Applicant: CLOVER MFG. CO., LTD., Osaka-shi, Osaka (JP)

(72) Inventor: Kanako Oe, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 820 days.

(21) Appl. No.: 14/259,515

(22) Filed: Apr. 23, 2014

(65) Prior Publication Data

US 2014/0318189 A1 Oct. 30, 2014

(30) Foreign Application Priority Data

Apr. 30, 2013 (JP) ..... 2013-095127

(51) Int. Cl.
*G09F 3/18* (2006.01)
*D04B 3/00* (2006.01)

(52) U.S. Cl.
CPC ..... *D04B 3/00* (2013.01)

(58) Field of Classification Search
CPC ..... Y10T 24/45419; Y10T 24/45424; Y10T 24/4664; D04B 3/00; A44B 9/125
USPC ..... 40/651, 655, 647, 661.04; 66/1 A
See application file for complete search history.

(56) References Cited

U.S. PATENT DOCUMENTS 4,030,166 A * 6/1977 Betters ..... A44B 9/125 24/708.7
7,877,916 B2 * 2/2011 Chamandy ..... G06K 19/07749 24/3.12
2006/0117629 A1 * 6/2006 Errington ..... G09F 3/20 40/658
2011/0005047 A1 * 1/2011 Gangakhedkar ..... B60P 7/0823 24/600.9
2014/0082980 A1 * 3/2014 Sherman ..... G09F 3/0295 40/316

FOREIGN PATENT DOCUMENTS

JP 49-119562 11/1974
JP 58-160180 A 10/1983
JP 60-169283 U 11/1985
JP 63-75373 U 5/1988
JP 1-147290 U 10/1989

* cited by examiner

*Primary Examiner* — Joanne Silbermann
(74) *Attorney, Agent, or Firm* — Hamre, Schumann, Mueller & Larson, P.C.

(57) ABSTRACT

A knitting marker is configured to be suspended from a yarn of the knit piece being made or from the knitting needle being used in the knitting. The knitting marker includes a main body, which may be a generally flat strip, and a suspension connected to the main body. The suspension may be in the form of a hook or a ring, configured to be suspended from a yarn or a knitting needle. The knitting maker also includes an information bearer that is connected stably or loosely to the main body for carrying information presented by symbols such as letters, numerals, and figures.

10 Claims, 9 Drawing Sheets

MARKER FOR KNITTING

BACKGROUND OF THE INVENTION

1. Field of the Invention

The present invention relates to a knitting marker (so-called stitch marker) configured to be attached to a knit piece or a knitting needle.

2. Description of the Related Art

In knitting, stitch markers are used to mark a certain position in the fabric being knitted. For instance, a plurality of stitch markers are attached to the rows of stitches at a regular interval, e.g. every five rows, to enable the user to easily count the number of rows. By using stitch markers in this way, the user can easily keep track of the progress of knitting or recognize the point where the knitting pattern should be changed during the knitting or in restarting the knitting that is once stopped.

An example of such a conventional stitch marker is disclosed in Japanese Examined Utility Model Application Publication No. H04-10235. With conventional stitch markers, however, the user needs to memorize the interval at which the stitch markers have been attached. Moreover, conventional stitch markers can be used only as a mark for counting the number of rows and cannot be used as a mark indicating other kinds of information, such as the name of the yarn, the size of the knitting needle and so on.

SUMMARY OF THE INVENTION

The present invention has been conceived under the circumstances described above. It is therefore an object of the present invention to provide a knitting marker that is convenient and used for various purposes.

According to an embodiment of the present invention, there is provided a knitting marker that includes: a main body; a suspension connected to the main body and configured to be suspended from a yarn or a knitting needle; and an information bearer connected to the main body for carrying information presented by a symbol.

Preferably, the information bearer includes a holder for holding an information carrying medium (such as a memo pad) on which the symbol is written.

Preferably, the suspension includes an elastically deformable hook having a base end and a tip end. The base end is attached to the main body, and the tip end is spaced apart from the main body when the hook is in the natural state, i.e., in a non-engaged state.

Preferably, the main body is provided with an engagement portion for engaging with the tip end of the hook so that a closed through-hole is provided by a combination of the main body and the hook.

Preferably, the engagement portion includes a standing wall extending from the main body, while also including an extension extending from an edge of the standing wall toward the base end of the hook.

Preferably, the holder includes a clip member for elastically holding the information carrying medium between the base body and the clip member.

Preferably, the main body is in the form of a plate, and the suspension and the main body are arranged along a common plane so that they appear to be linearly aligned as viewed in a particular direction.

Preferably, the clip member includes a base end connected to the main body, a distal end opposite to the base end, a first inclined portion and a second inclined portion. The first inclined portion is arranged to become closer to the main body as proceeding from the base end of the clip member toward the distal end of the clip member. The second inclined portion is connected to the first inclined portion and arranged to become further away from the main body as proceeding toward the distal end of the clip member.

Preferably, the main body is formed with a projection projecting toward the clip member. The projection is in contact with or slightly spaced apart from a corresponding one of the first inclined portion and the second inclined portion.

Preferably, the main body, the suspension and the holder are made as a single piece from a synthetic resin.

Other features and advantages of the present invention will become more apparent from detailed description given below with reference to the accompanying drawings.

DESCRIPTION OF THE PREFERRED EMBODIMENTS

Preferred embodiments of the present invention are described below with reference to the accompanying drawings.

Figure 1:
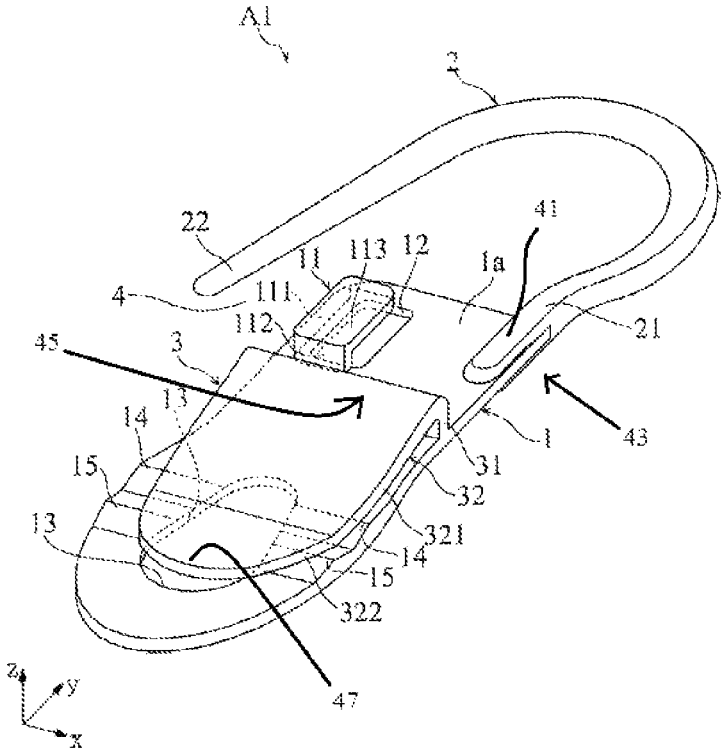
FIG. 1 is a perspective view of a knitting marker according to a first embodiment the present invention.
Figure 2:
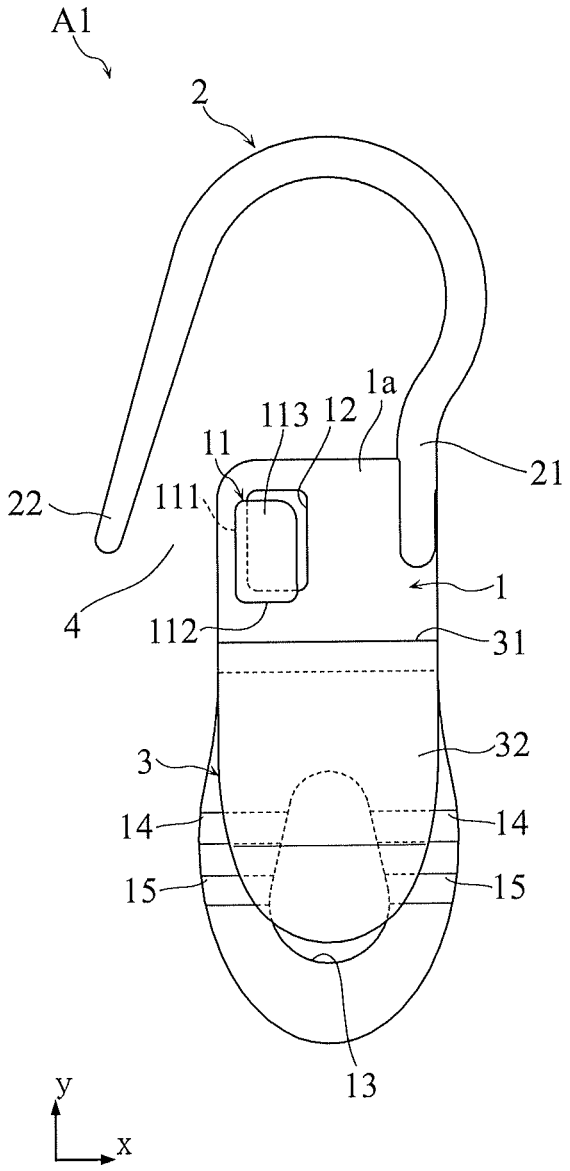
FIG. 2 is a front view of the knitting marker of FIG. 1.

FIGS. 1-5 show a knitting marker A1 according to a first embodiment of the present invention. As shown in FIGS. 1 and 2, the knitting marker A1 of this embodiment includes a main body 1, a suspension 2 and a knitting information bearer 3. In the illustrated example, the information bearer 3 is configured as a pinching holder to detachably hold an information carrying medium 5 (see FIG. 4).

The suspension 2 can be hooked onto a stitch. In the illustrated example, the suspension 2 is an elastically deformable portion, having a curved shape like a hook and extending within the plane containing the sheet surface of FIG. 2. The suspension 2 has a base end 21 and a tip end 22 opposite to the base end 21.

The base end 21 of the suspension 2 is integrally connected to the main body 1, while the tip end 2 is formed as a free end. As illustrated in FIG. 1, the base end 21 includes a first piece 41 and a second piece 43 that connects to the main body 1. In the natural state as shown in FIGS. 1 and 2, the tip end 22 is spaced apart from the main body 1, so that there is a gap 4 between the tip end 22 and the main body 1. The tip end 22 is tapered and can be brought into engagement with an engagement portion 11, as described later.

Figure 3:
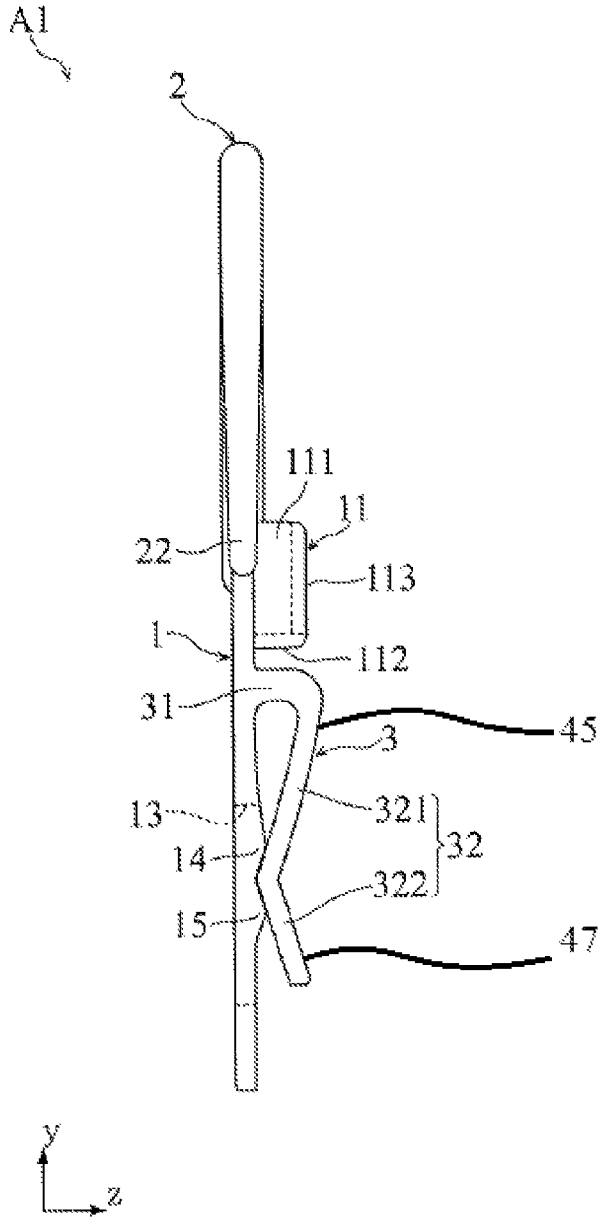
FIG. 3 is a left side view of the knitting marker of FIG. 2.

The main body 1 is in the form of a plate having a predetermined thickness in the direction z. In this embodiment, as shown in FIG. 3, the main body 1 and the suspension 2 are arranged to extend along a common plane (flat surface), so that the main body 1 and the suspension 2 are aligned straightly, as viewed in the direction x (see FIG. 3). The main body 1 is elongated in the direction y and has a width in the direction x. The base end 21 of the suspension 2 is connected to the main body 1 at the first end (upper end in FIG. 2) in the longitudinal direction y and at the first end (right end in FIG. 2) in the width direction x. In the natural state, the tip end 22 of the suspension 2 is positioned to the left of the main body 1 (see FIG. 2).

In this embodiment, the main body 1 is provided with the engagement portion 11 cooperating with the suspension 2. The engagement portion 11 is provided at the first end (upper end in FIG. 2) in the longitudinal direction y and at the second end (left end in FIG. 2) in the width direction x of the main body 1. By elastically deforming the suspension 2, the tip end 22 is brought into engagement with the engagement portion 11 (see FIG. 4).

The engagement portion 11 includes standing walls 111, 112 and an extension 113. The standing walls 111 and 112 extend from the obverse surface 1*a* of the main body 1 in the thickness direction z. In the illustrated example, the standing walls 111 and 112 are upright to the obverse surface 1*a* of the main body 1, though the present invention is not limited to this. The standing wall 111 faces in the direction x. The standing wall 112 faces in the direction y and extends from the lower end in FIG. 2 of the standing wall 111 toward the base end 21 of the suspension 2 (to the right in FIG. 2). The extension 113 faces in the direction z and is parallel to the obverse surface 1*a* of the main body 1 (see FIG. 5). The extension 113 is connected to the top edges of the respective standing walls 111, 112 (in FIG. 5, the horizontal extension 113 is connected to the top edge of the standing wall 111).

The main body 1 is formed with a generally rectangular hole 12 adjacent to the engagement portion 11. As viewed in plan (see FIG. 2), the hole 12 at least partially overlaps the extension 113. The hole 12 penetrates the main body 1 in the thickness direction z.

As shown in FIG. 2, the main body 1 is formed with another hole 13 and projections 14, 15 adjacent to the second end (lower end in FIG. 2) in the longitudinal direction y. The second hole 13 also penetrates the main body 1 in the thickness direction z. In the illustrated example, the second hole 13, having an oblong shape of a broader base and a narrower opposite end, is greater in size and opening area than the first hole 12.

The projections 14 and 15 project from the obverse surface 1*a* of the main body 1 in the thickness direction z. The projections 14 and 15 are arranged side by side in the direction y. Each of the projections 14 and 15 is elongated in the width direction x and provided on each side of the opening 13. As viewed in the direction z (see FIG. 2), each of the projections 14, 15 has two end portions that are not overlapped by the information bear 3.

The information bearer 3, or the information carrying medium holder 3 in this embodiment, is used to hold an information carrying medium 5 (see FIG. 4) such as memo paper on which knitting information 51 presented by e.g. symbols such as letters, numerals, figures, etc. can be written. The information carrying medium holder 3 includes a standing portion 31 and a clip member 32 connected to the standing portion 31.

The standing portion 31 stands on the obverse surface 1*a* of the main body 1 and is connected to the obverse surface 1*a* at or near the middle point of the main body 1 in the longitudinal direction y (see FIG. 3). The standing portion 31 is elongated in the width direction x of the main body 1.

The clip member 32 faces the main body 1 as shown in FIG. 3. Due to the structure and the constituting material, the clip member 32 can elastically hold the information carrying medium 5 between itself and the main body 1. The clip member 32 has a base portion 45 connected to the standing portion 31 (hence to the main body 1) and a distal end 47 distant from the base end toward the second end of the main body 1 in the longitudinal direction y (lower end in FIG. 2). The clip member 32 is bent and hence includes a base-side inclined portion (first inclined portion) 321 and a distal-side inclined portion (second inclined portion) 322. The base-side inclined portion 321 is so inclined as to become closer to the main body 1 in the thickness direction z as proceeding in the direction y from the base portion 45 toward the distal end 47. The distal-side inclined portion 322 is so inclined as to become further away from the main body 1 in the thickness direction z as proceeding in the direction y toward the distal end 47. The bent and its adjacent portions of the clip member 32 may be in contact with the main body 1. In the illustrated example, a part of the base-side inclined portion 321 is in contact with the projection 14, whereas a part of the distal-side inclined portion 322 is in contact with the projection 15.

The knitting marker A1, including the main body 1, the suspension 2 and the holder 3, may be made as a single piece from a synthetic resin such as polyacetal resin. The knitting marker A1 can be made by using a mold including three or more split mold members.

The knitting marker A1 may be used in the following manner.

Figure 4:
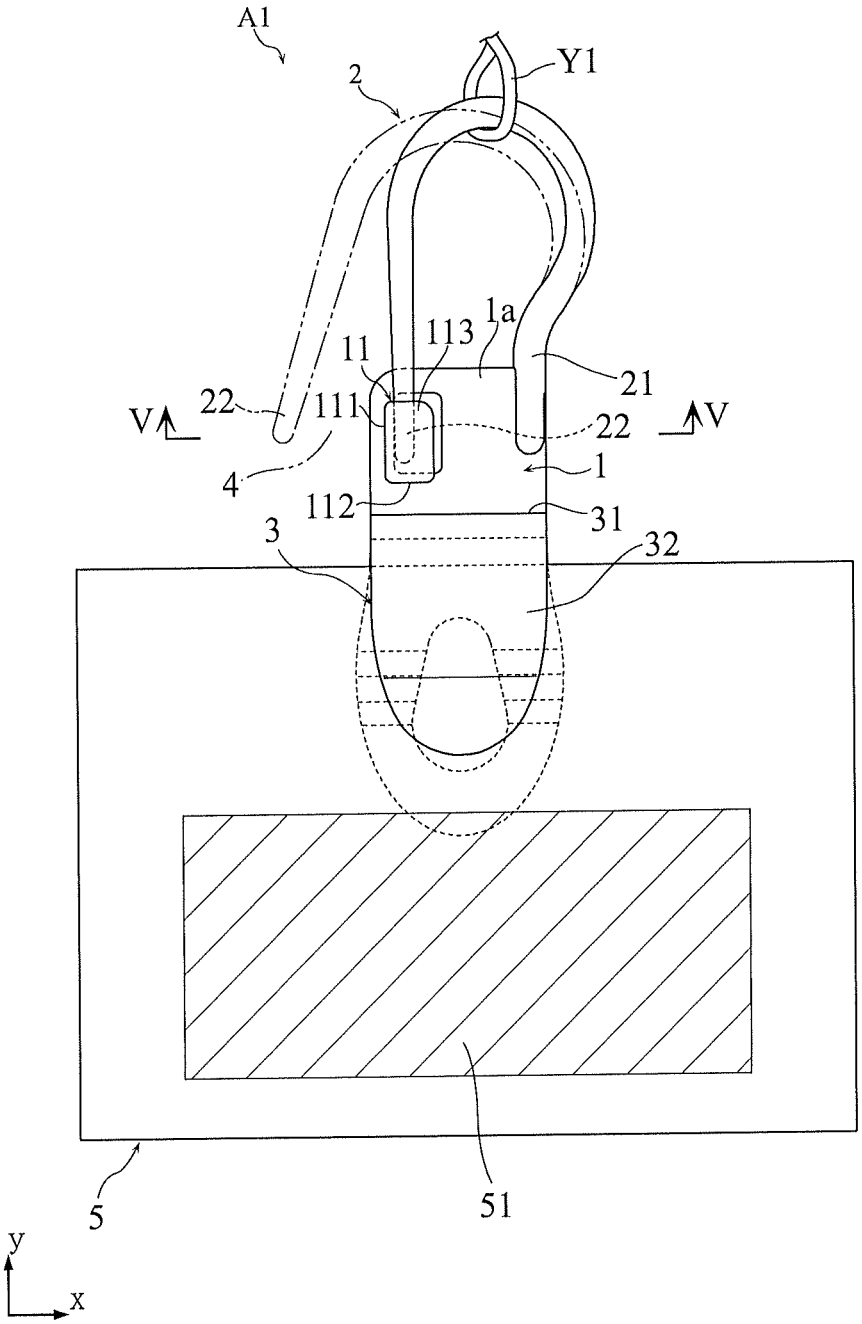
FIG. 4 is a front view of the knitting marker of FIG. 1 in use.
Figure 5:
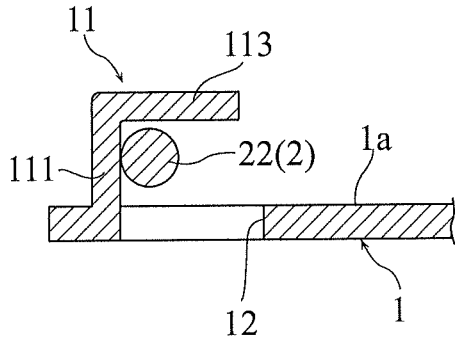
FIG. 5 is an enlarged sectional view taken along lines V-V in FIG. 4.

As shown in FIG. 4, knitting information 51 presented by symbols is written on the information carrying medium 5 such as memo paper with a suitable writing tool. Then, the information carrying medium 5 is attached to the knitting marker A1. Specifically, the information carrying medium 5 is inserted between the main body 1 and the clip member 32 so as to be held by the spring action of the clip member 32. In this state, the suspension 2 is in the natural state indicated by the double-dashed lines in FIG. 4. The information 51 may be written on the information carrying medium 5 after the medium is inserted between the main body 1 and the clip member 32. In the illustrated example (see FIG. 4), the information carrying medium 5 is greater in width (the dimension measured in the direction x) than the main body 1, and also greater in length (the dimension measured in the direction y) than the main body 1.

Then, as shown in FIG. 4, the suspension 2 is hooked onto a selected one of the stitches of the fabric being knitted, by passing the yarn Y1 through the gap 4 between the main body 1 and the tip end 22 of the suspension 2. Then, the suspension 2 is elastically deformed as indicated by the solid line in FIG. 4, so that the tip end 22 is brought into engagement with the engagement portion 11 (see also FIG. 5). In this state, a closed loop is formed by the suspension 2 and the main body 1, thereby preventing the yarn Y1 from coming off the suspension 2.

The advantages of the knitting marker A1 are as follows.

The knitting marker A1 includes the information carrying medium holder 3 for holding the information carrying medium 5 in which various pieces of information 51 relating to the knitting can be written (or prewritten) by the user. By this arrangement, for example, a plurality of knitting markers A1 are attached to a knit piece at predetermined intervals, and the user may write the numeral indicating the interval on the information carrying medium 5 as the information 51 for each knitting marker A1. In this manner, the user does not need to memorize the number of the interval. Instead of or in addition to the information about the interval, other pieces of information such as the kind of knitting pattern, the name of the yarn or the size of the knitting needle can be written as information 51 in the information carrying medium 5. Thus, the knitting marker A1 can be used for various purposes.

As described above, the suspension 2 and the main body 1 form a closed loop with the tip end 22 kept in engagement with the engagement portion 11. Thus, the knitting marker A1 is prevented from dropping from the yarn Y1.

As described above, the engagement portion 11 includes the standing wall 111 standing on the obverse surface 1*a* of the main body 1 and the extension 113 connected to the top edge of the standing wall 111. As understood from FIGS. 4 and 5, when the suspension 2 is in engagement with the engagement portion 11, the elastic recovery force of the suspension 2 acts to the left in FIGS. 4 and 5. With the above-described structure of the engagement portion 11, the tip end 22 of the suspension 2 is surrounded by the main body 1, the standing wall 111 and the extension 113. Thus, the tip end 22 is prevented from being disengaged from the engagement portion 11.

The information carrying medium holder 3 includes the clip member 32 configured to elastically hold the information carrying medium 5 between itself and the main body 1. Thus, the information carrying medium 5 can be easily attached to the knitting marker A1 simply by inserting the information carrying medium 5 into between the main body 1 and the clip member 32.

As described above, the clip member 32 is bent and includes the base-side inclined portion 321 and the distal-side inclined portion 322, and the bent and its adjacent portions of the clip member 32 are in contact with the main body 1. (Alternatively, the clip member 32 may be slightly spaced apart from the main body 1, depending on the thickness of the information carrying medium 5). This ensures that the information carrying medium 5 is properly and stably held between the clip member 32 and the main body 1. Further, the distal-side inclined portion 322 is inclined in such a manner as to become further away from the main body 1 in the thickness direction z as proceeding toward the distal end. Thus, in inserting the information carrying medium 5, the medium 5 is guided along the distal-side inclined portion 322 and hence smoothly inserted.

As shown in FIG. 3, in this embodiment, the base-side inclined portion 321 is in contact with the projection 14 of the main body 1 (or may be slightly spaced apart from the projection 14), and the distal-side inclined portion 322 is in contact with the projection 15 of the main body 1 (or may be slightly spaced apart from the projection 15). This arrangement increases the contact area with the information carrying medium 5. Moreover, the information carrying medium 5 is held at a plurality of regions separate from each other in the insertion direction of the medium 5. This arrangement prevents the information carrying medium 5 between the clip member 32 and the main body 1 from moving in the insertion direction.

FIGS. 6-9 show other embodiments of the present invention. In these figures, the elements that are identical or similar to those of the foregoing embodiment are designated by the same reference signs as those used in the foregoing embodiment, and description of these elements is omitted where appropriate.

Figure 6:
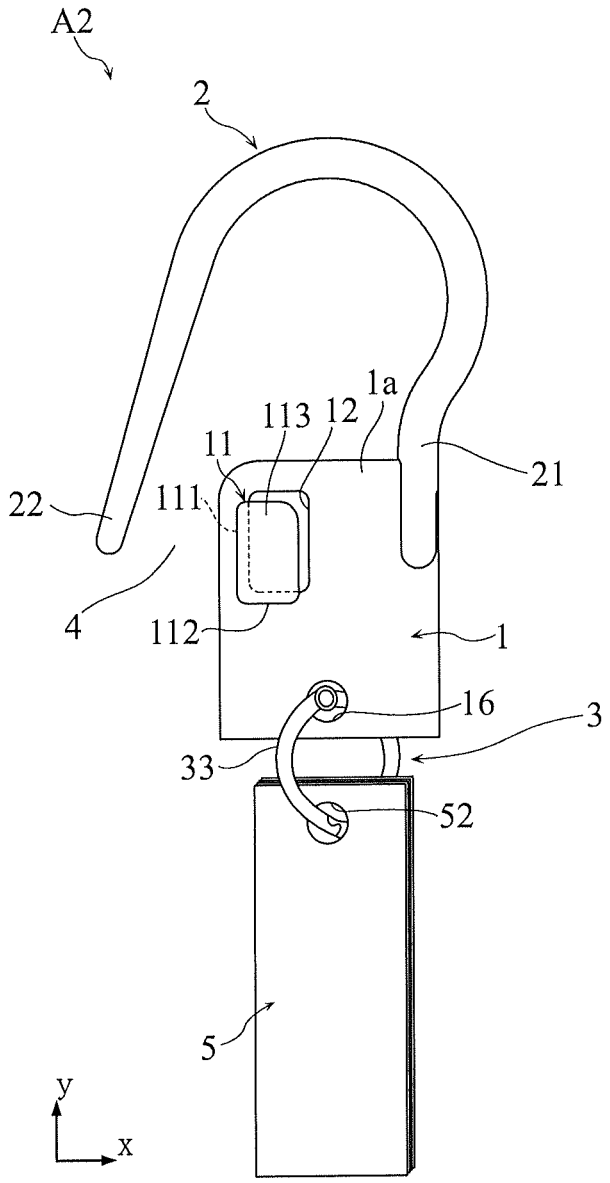
FIG. 6 is a front view of a knitting marker according to a second embodiment of the present invention.

FIG. 6 shows a knitting marker A2 according to a second embodiment of the present invention. The knitting marker A2 differs from the knitting marker A1 of the first embodiment in structure of the information carrying medium holder 3, and in structure of the portions of the main body 1 which are related to the information carrying medium holder 3. The structures of the suspension 2 and the portions of the main body 1 which are related to the suspension 2 are the same as those of the first embodiment.

The information carrying medium holder (information bearer) 3 of the knitting marker A2 includes a ring member 33. The ring member 33 may be made up of two semicircular elements hinged to each other at one ends thereof and is configured to be openable and closable as desired. Unlike the first embodiment, the main body 1 of the knitting marker A2 does not include the projections 14, 15 and the relatively large hole 13, but includes a hole 16 for passing the ring member 33. The hole 16 may have a diameter large enough to loosely hold the ring member 33. Similarly, the information carrying medium 5 of this embodiment has a hole 52 for passing the ring member 33. The information carrying medium 5 may be a piece of paper or any other materials upon which the user can put information relating to the knitting. In use, the ring member 33 in the open state is passed through the hole 16 of the main body 1 and the hole 52 of the information carrying medium 5. Then, the ring member 33 is closed so that the information carrying medium 5 is suspended from the ring member 33 without dropping from the ring member 33.

According to the second embodiment, the ring member 33 can hold a plurality of information carrying media 5 as stacked one upon another. In use, information is written on one of the information carrying media 5 and the knitting marker A2 is attached to a particular stitch of the fabric being knitted. After the knitting marker A2 is detached from the knitting, the used information carrying medium 5 can be removed by e.g. pulling the medium 5 off the ring member 33. When the knitting marker A2 is used the next time, information can be written in another of the information carrying media 5.

Figure 7:
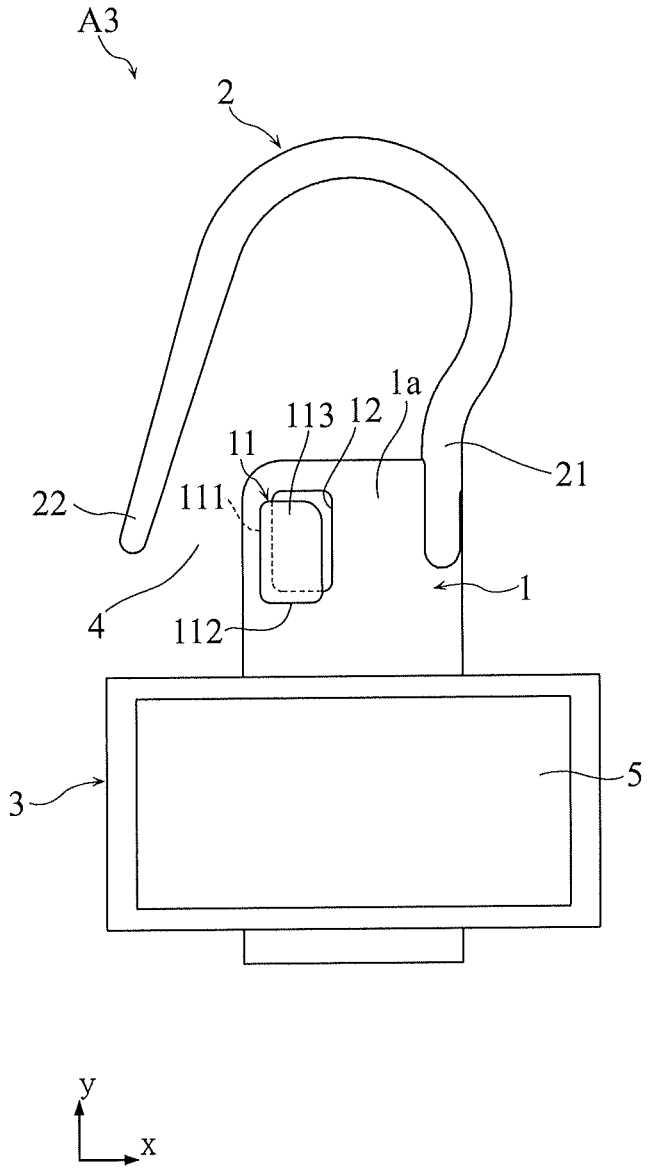
FIG. 7 is a front view of a knitting marker according to a third embodiment of the present invention.

FIG. 7 shows a knitting marker A3 according to a third embodiment of the present invention. In the knitting markers A1 and A2 of the previous embodiments, the information carrying medium 5 is detachably attached to the main body 1. In the knitting marker A3 of the third embodiment, an information carrying medium 5 is fixed to the main body 1 via a plate-shaped information bearer 3 which is directly fixed to the obverse surface 1*a* of the main body 1. In the illustrated example, the information carrying medium 5 is an information rewritable member (which may preferably be a sheet member bonded to the information bearer 3) on which or from which information can be written or erased by using a special writing tool or erasing tool. The structures of the suspension 2 and the portions of the main body 1 related to the suspension 2 are the same as those of the first and the second embodiments. Alternatively, the information carrying medium 5 may not be a member prepared separately from the medium 5, but may be an integral part of the information bearer 3. In this case, information relating to the knitting is to be written directly on the information bearer 3.

The knitting markers A1-A3 of the above embodiments are described as markers used by hooking the suspension 2 onto a stitch. As readily understood, the same markers can be used in a different manner. For instance, the knitting markers A1-A3 can be used by hooking the suspension 2 onto a knitting needle.

Figure 8:
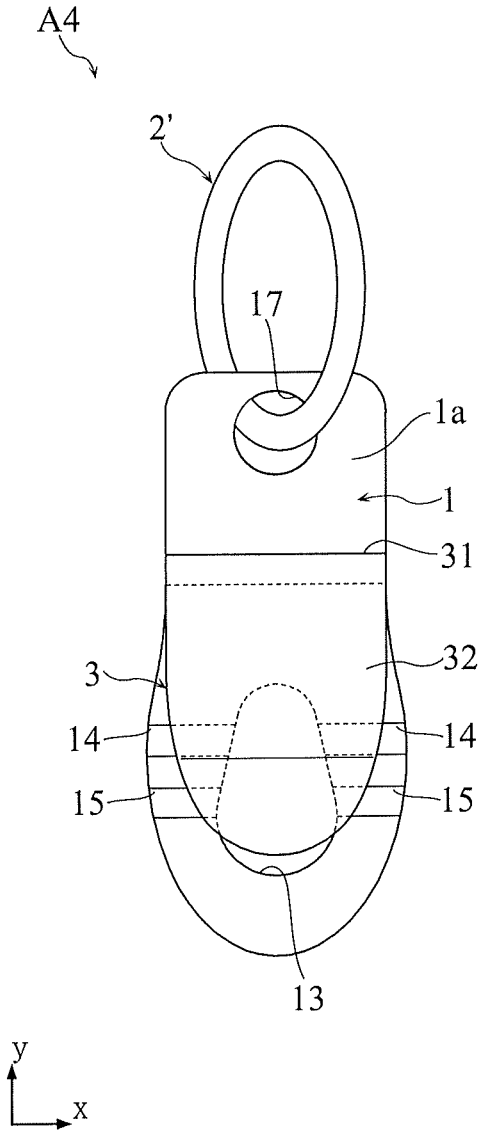
FIG. 8 is a front view of a knitting marker according to a fourth embodiment of the present invention.

FIG. 8 shows a knitting marker A4 according to a fourth embodiment of the present invention. The knitting marker A4 of this embodiment includes a suspension 2' different in structure from those of the first through third embodiments. Specifically, the suspension 2' of the knitting marker A4 is in the form of a ring (endless circular member). The main body 1 includes a hole 17 which penetrates the main body 1 in the thickness direction z and which the suspension 2' is passed through. The hole 17 is provided adjacent to the first end (upper end in FIG. 8) in the longitudinal direction y. Thus, the main body 1 and the suspension 2' are connected to each other, whereby the main body together with the information carrying medium holder (information bearer) 3 can be suspended from a knitting needle (or a yarn) via the suspension 2'.

Figure 9:
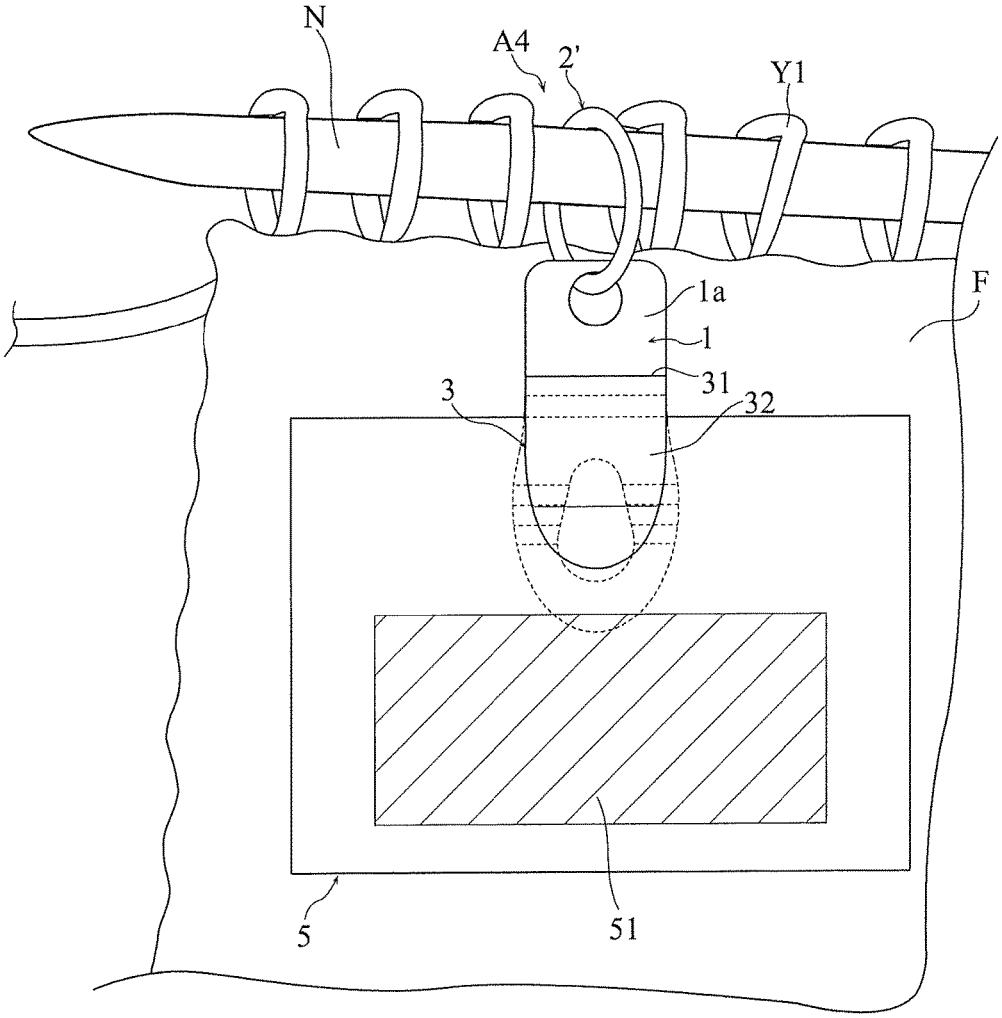
FIG. 9 is a front view of the knitting marker of FIG. 8 in use.

The knitting marker A4 may be used as shown in FIG. 9. Specifically, the knitting marker A4 can be suspended from the knitting needle N by passing the knitting needle N through the suspension 2'. The knitting marker A4 can be used e.g. for counting the number of stitches in a row in the fabric F being knitted.

The present invention is not limited to the foregoing embodiments and can be varied in many ways without departing from the spirit of the present invention. For instance, the shape and material of the knitting marker are not limited to those described in the foregoing embodiments. The information to be carried by the information bearer is not limited to the information about the rows of stitches but includes various kinds of information, such as information about the kind of knitting pattern, the name of the yarn, the size of the knitting needle and so on.

The invention claimed is:

1. A knitting marker, comprising:

an elongated main body having an obverse surface and a reverse surface and having a straight first end and a curved second end that are spaced from each other in a longitudinal direction of the main body;

a suspension connected to the first end of the main body and configured to be suspended from one of a yarn and a knitting needle; and an information bearer provided on a side of the second end of the main body for carrying information presented by a symbol, wherein the suspension includes an elastically deformable hook having a base end and a tip end, the base end being attached to the first end of the main body, when the hook is in a natural state, the tip end of the hook is spaced apart from the first end of the main body in a first direction perpendicular to the longitudinal direction as viewed in plan, the obverse surface of the main body is provided with an engagement portion for engaging with the tip end of the hook, the information bearer includes a holder holding an information carrying medium on which the symbol is written, the holder includes a clip member elastically holding the information carrying medium between the base body and the clip member the clip member includes a base portion connected to the main body and a curved distal end opposite to the base portion in the longitudinal direction, and the curved distal end of the clip member is offset toward the first end of the main body with respect to the curved second end of the main body in the longitudinal direction.

2. The knitting marker according to claim 1, wherein the engagement portion includes a standing wall extending from the obverse surface of the main body and an extension extending from an edge of the standing wall toward the base end of the hook.

3. The knitting marker according to claim 1, wherein the suspension and the main body are arranged along a common plane.

4. The knitting marker according to claim 1, wherein the clip member includes a first inclined portion and a second inclined portion, the first inclined portion being arranged to become closer to the main body as proceeding from the base portion of the clip member toward the distal end of the clip member, the second inclined portion being connected to the first inclined portion and arranged to become further away from the main body as proceeding toward the distal end of the clip member.

5. The knitting marker according to claim 4, wherein the main body is formed with a projection projecting toward the clip member, and the projection is in contact with or slightly spaced apart from one of the first inclined portion and the second inclined portion.

6. The knitting marker according to claim 1, wherein the main body, the suspension and the holder are made as a single piece from a synthetic resin.

7. The knitting marker according to claim 1, wherein the hook has a generally circular cross section.

8. The knitting marker according to claim 1, wherein the engagement portion is fixed unmovably to the main body.

9. The knitting marker according to claim 1, wherein the base end of the hook is formed with a first piece and a second piece that are in contact with the obverse surface and the reverse surface of the main body, respectively.

10. The knitting marker according to claim 1, wherein the base portion of the clip member is closer to the hook in the longitudinal direction than is the distal end.

* * * * *